US009723874B2

(12) United States Patent
Liu

(10) Patent No.: US 9,723,874 B2
(45) Date of Patent: Aug. 8, 2017

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 609 days.

(21) Appl. No.: 14/055,328

(22) Filed: Oct. 16, 2013

(65) Prior Publication Data

US 2015/0027464 A1 Jan. 29, 2015

(30) Foreign Application Priority Data

Jul. 26, 2013 (CN) ..... 2013 2 0453632 U

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2009/0095310 A1* 4/2009 Chaoui ..... A24F 1/30 131/173
2011/0303231 A1* 12/2011 Li ..... A24F 47/008 131/329
2012/0174935 A1* 7/2012 Steinberg ..... A24F 1/32 131/329
2013/0192615 A1* 8/2013 Tucker ..... H01C 17/00 131/328
2014/0014124 A1* 1/2014 Glasberg ..... A24F 47/008 131/328
2014/0041655 A1* 2/2014 Barron ..... A61M 11/042 128/202.21
2014/0261493 A1* 9/2014 Smith ..... A24F 47/008 131/328

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

An electronic cigarette comprising a battery pole, an atomizer, and a connecting mechanism disposed between the battery pole and the atomizer and configured for connecting the battery pole to the atomizer is provided; the connecting mechanism includes a first connecting member and a second connecting member; and the first connecting member includes a first buckled portion and a first connecting portion detachably connected with the first buckled portion; the second connecting member includes an accommodating portion fitting for the first buckled portion; and the first buckled portion is fixed in the accommodating portion, so that the first buckled portion is detachably buckled with the second connecting member. The electronic cigarette of the present application is easy to assemble and disassemble, and convenient to produce.

7 Claims, 3 Drawing Sheets

ELECTRONIC CIGARETTE

CROSS-REFERENCE TO RELATED APPLICATIONS

This non-provisional application claims priorities under 35 U.S.C. §119(a) on Patent Application No. 201320453632.4 filed in P.R. China on Jul. 26, 2013, the entire contents of which are hereby incorporated by reference.

FIELD OF THE INVENTION

The present application relates to the field of electrical products, and more particularly relates to an electronic cigarette.

BACKGROUND OF THE INVENTION

In prior art, as a battery pole of an electronic cigarette and an atomizer of the electronic cigarette are connected with each other by adopting threads, the threads need to twist many circles to assemble the battery pole into the atomizer or disassemble the battery pole from the atomizer, and thus the assembly process or the disassembly process is inconvenient to achieve. In some electronic cigarettes, a battery pole is buckled with a corresponding atomizer, and the battery pole and the atomizer are usually an integral structure respectively, so that the battery pole and the atomizer are inconvenient to assemble or disassemble. Besides, it is difficult to produce the battery pole and the atomizer that respectively have complicated structures.

SUMMARY OF THE INVENTION

The objective of the present application is to provide an electronic cigarette that is convenient to disassemble, assemble and produce, aiming at the defect that the battery pole and the atomizer buckled with the battery pole are difficult to assemble, disassemble and produce.

The technical solutions of the present application for solving the technical problems are as follows:

in one aspect, an electronic cigarette comprising a battery pole, an atomizer, and a connecting mechanism disposed between the battery pole and the atomizer and configured for connecting the battery pole to the atomizer is provided; the connecting mechanism includes a first connecting member and a second connecting member; and the first connecting member includes a first buckled portion and a first connecting portion detachably connected with the first buckled portion; the second connecting member includes an accommodating portion fitting for the first buckled portion; and the first buckled portion is fixed in the accommodating portion, so that the first buckled portion is detachably buckled with the second connecting member.

In one embodiment, the second connecting member further includes a second connecting portion; and the second connecting portion is detachably connected with the accommodating portion.

In another embodiment, the second connecting portion includes a second inserted pipe and a second sleeve integrated with the second inserted pipe; and the accommodating portion is inserted in the second sleeve.

In the embodiment, a side edge of the accommodating portion defines a guiding recess configured for cooperatively enabling the first buckled portion to be inserted in the accommodating portion; and an inner surface of the accommodating portion defines a locating recess disposed peripherally and communicating with the guiding recess; and a protruding portion is formed on the edge of the outside of the first buckled portion; when the first buckled portion is inserted in the accommodating portion, the protruding portion firstly moves along the guiding recess and then rotationally enters the locating recess of the accommodating portion.

In the embodiment, the first connecting portion is cylindrical; and the first buckled portion is cylindrical, and includes a first section and a second section integrated with the first section; the first section is inserted in the first connecting portion; and the protruding portion is mounted on the second section.

In the embodiment, the electronic cigarette further comprises a first electrode pillar and a second electrode pillar; the first electrode pillar is embedded in the second connecting member; and the second electrode pillar is embedded in the first connecting member; when the first connecting member is buckled with the second connecting member, the first electrode pillar abuts against the second electrode pillar, and electrically connects with the second electrode pillar.

In the embodiment, a first through-hole configured for air flow is defined in the first electrode pillar; and a second through-hole configured for air flow is defined in the second electrode pillar; and the first through-hole communicates with the second through-hole.

In the embodiment, the first connecting portion and the second connecting portion are made of metal; the atomizer includes a heating filament; and two ends of the heating filament are electrically connected to the first connecting portion and the second electrode pillar respectively; and two terminals of a battery are electrically connected to the second connecting portion and the first electrode pillar respectively; and thus when the first connecting member is buckled with the second connecting member, the first connecting portion is electrically connected to the second connecting portion.

In the embodiment, a first limiting ring is peripherally mounted on an end of the first connecting portion that is adjacent to the first buckled portion.

In the embodiment, a second limiting ring is peripherally mounted on an end of the second connecting portion that is adjacent to the accommodating portion.

When implementing the electronic cigarette of the present application, the following advantageous effects can be achieved: the first connecting member of the present application is formed by the first connecting portion and the first buckled portion detachably connected with the first connecting portion, so that the electronic cigarette is easy to assemble and disassemble, and convenient to produce.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

Figure 1:
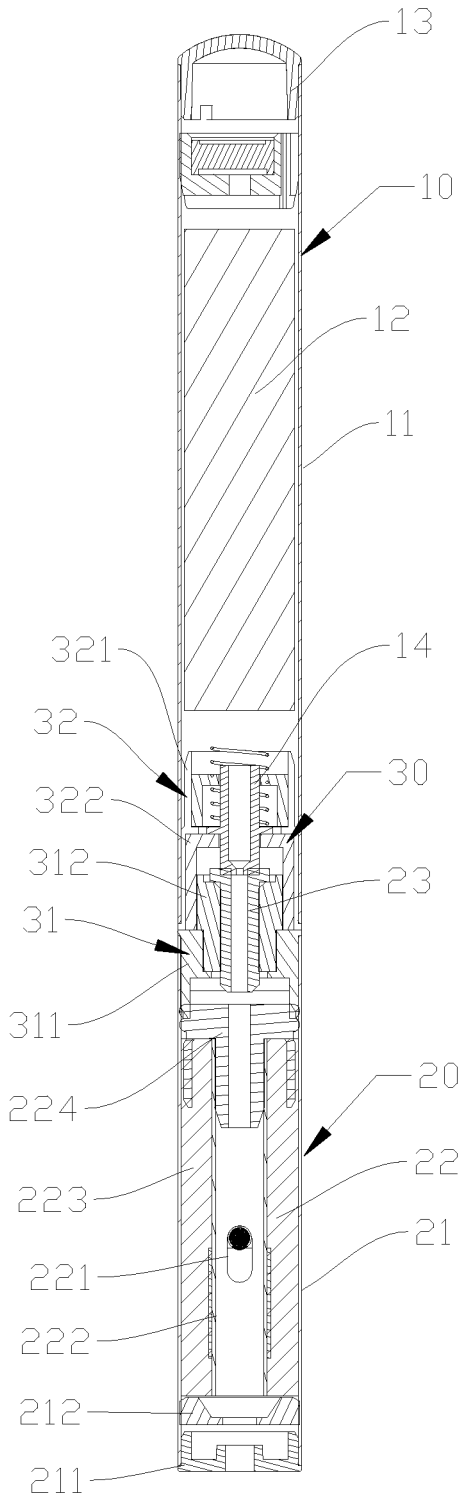
FIG. 1 is a structural schematic view of an electronic cigarette of an embodiment of the present application.

FIG. 1 shows an electronic cigarette of an embodiment of the present application. The electronic cigarette comprises a battery pole 10, an atomizer 20 and a connecting mechanism 30. The connecting mechanism 30 is disposed between the battery pole 10 and the atomizer 20, and connects the battery pole 10 to the atomizer 20, the connection by buckling way is detachable, which is convenient to assemble and disassemble. Compared with threaded connections, this buckling connection can be achieved or released without twisting many circles process.

The battery pole 10 includes a first shell 11, a battery 12, a lamp assembly 13 and a first electrode pillar 14. The first shell 11 is a cylindrical structure; and the battery 12 is arranged in the first shell 11. The lamp assembly 13 electrically connected to the battery 12 is mounted on an end of the first shell 11 that is away from the atomizer 20, which can glow to substitute burning light effect of tobacco. A first through-hole (not shown) configured for air flow is defined in the first electrode pillar 14 along an axial direction of the first electrode pillar 14.

The atomizer 20 includes a second shell 21, an atomizing assembly 22 and a second electrode pillar 23. The atomizing assembly 22 is disposed in the second shell 21. A second through-hole (not shown) configured for air flow is defined in the second electrode pillar 23 along an axial direction of the second electrode pillar 23; and the second through-hole communicates with the first through-hole.

The atomizing assembly 22 includes a heating filament 221, a PVC-painted fiberglass pipe 222, oil-stored cotton 223 and an atomizing seat 224. The atomizing seat 224 is mounted on an end of the PVC-painted fiberglass pipe 222 that is adjacent to the battery pole 10. The atomizing seat 224 is made of rubber or another elastic material. The atomizing seat 224 not only has a function of fixing the PVC-painted fiberglass pipe 222, but prevents tobacco juice in the atomizing assembly 22 from flowing into the battery pole 10. The second shell 21 is cylindrical; and a cigarette-holder and a cigarette-holder cap 211 configured for keeping the cigarette-holder clean are arranged on an end of the second shell 21 that is away from the battery pole 10. A sealing ring 212 is disposed between the cigarette-holder and the atomizing assembly 22, and configured for preventing the tobacco juice in the atomizing assembly 22 from flowing into the cigarette-holder.

The connecting mechanism 30 includes a first connecting member 31 and a second connecting member 32. The first connecting member 31 is detachably connected to the atomizer 20, and includes a first connecting portion 311 and a first buckled portion 312 detachably connected with the first connecting portion 311. The second connecting member 32 is detachably connected to the battery pole 10, and includes a second connecting portion 321 and an accommodating portion 322 detachably connected with the second connecting portion 321. The first buckled portion 312 is fixed in the accommodating portion 322, so that the first connecting member 31 is detachably buckled with the second connecting member 32. As the first connecting member 31 and the second connecting member 32 are respectively disassembled into two separated members, the first connecting member 31 and the second connecting member 32 are easy to disassemble and assemble, and convenient to produce. It can be understood that positions of the first connecting member 31 and the second connecting member 32 can be exchanged.

Figure 2:
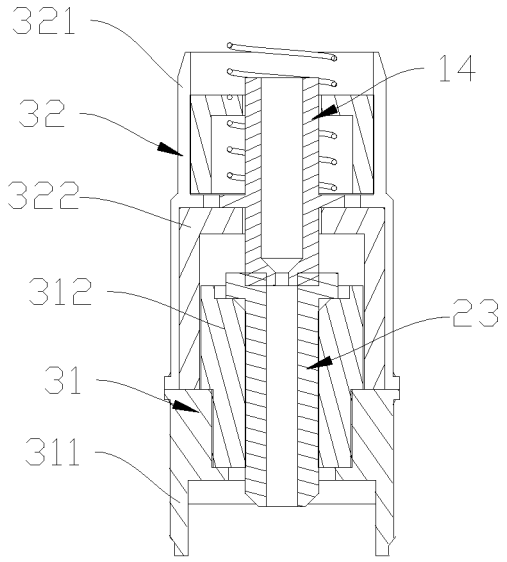
FIG. 2 is a cut-away view of a connecting mechanism of the electronic cigarette of the embodiment shown in FIG. 1.
Figure 3:
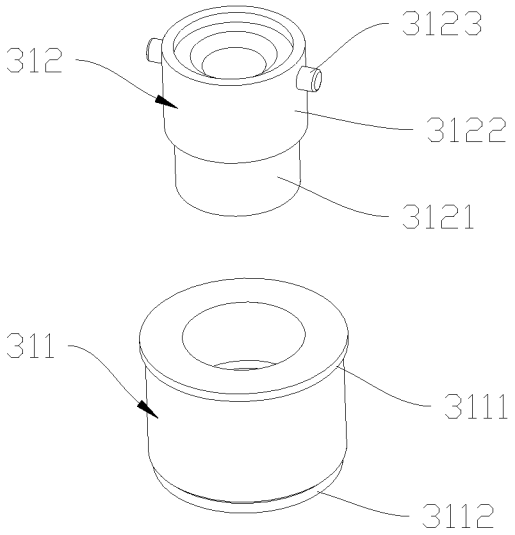
FIG. 3 is an exploded structural schematic view of a first connecting member of the electronic cigarette of the embodiment shown in FIG. 1.

As shown in FIGS. 2 to 3, in the present embodiment, the first buckled portion 312 is cylindrical, and made by plastic injection; and the first buckled portion 312 includes a first section 3121 and a second section 3122 integrated with the first section 3121. The first section 3121 and the second section 3122 are cylindrical, and coaxial with each other; and an external diameter of the first section 3121 is less than an external diameter of the second section 3122. The first section 3121 is embedded in the first connecting portion 311. Of course, the connection between the first section 3121 and the first connecting portion 311 can be achieved by interference fit, magnetic forces and threads, etc. Two protruding portions 3123 are arranged on edge of outside surface of the second section 3122. The two protruding portions 3123 are cylindrical; an axial direction of each of the two protruding portions 3123 coincides with the radial direction of the second section 3122; and the two protruding portions 3123 are coaxial with each other.

The first connecting portion 311 is cylindrical, and made of conductive metal. An internal diameter of the first connecting portion 311 is fit for an external diameter of the first section 3121, so that the first section 3121 can be just inserted in the first connecting portion 311. An external diameter of the first connecting portion 311 is fit for an internal diameter of the atomizer 20, so that the first connecting portion 311 has interference fit to the atomizer 20. A first limiting ring 3111 is mounted on an end of the first connecting portion 311 that is adjacent to the first buckled portion 312; and a chamfer 3112 configured for enabling the first connecting portion 311 to be inserted in the atomizer 20 more easily is arranged on an end of the first connecting portion 311 that is away from the first buckled portion 312. The first limiting ring 3111 prevents the first connecting portion 311 from being entirely inserted in the atomizer 20, so that the first connecting portion 311 can be disassembled from the atomizer 20 more easily.

Figure 4:
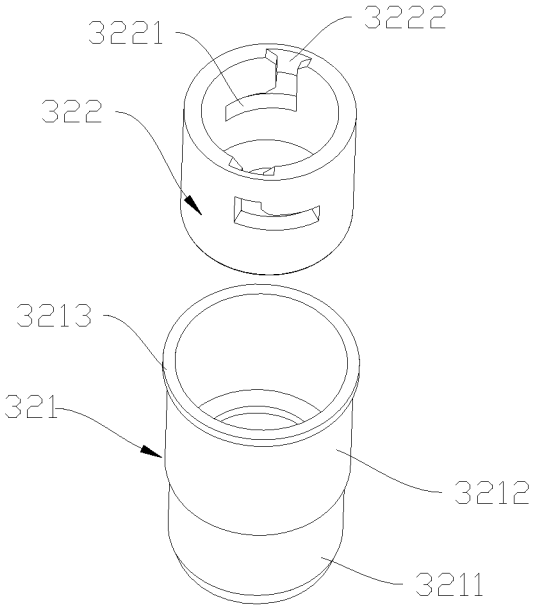
FIG. 4 is an exploded structural schematic view of a second connecting member of the electronic cigarette of the embodiment shown in FIG. 1.

As shown in FIGS. 2 to 4, the accommodating portion 322 is cylindrical, and made of plastic injection. An internal diameter of the accommodating portion 322 is fit for an external diameter of the first buckled portion 312. Two locating recesses 3221 configured for fitting for the protruding portion 3123 are peripherally defined in the inner surface of the accommodating portion 322; and two guiding recesses 3222 respectively configured for cooperatively enabling the first buckled portion 312 to be inserted in the accommodating portion 322 are defined in a side edge of the accommodating portion 322; and the guiding recesses 3222 communicate with the locating recesses 3221. When the first buckled portion 312 is inserted in the accommodating portion 322, the protruding portion 3123 firstly moves along the guiding recesses 3222 and then enters rotationally the locating recesses 3221 of the accommodating portion 322.

Moreover, the depths of the guiding recesses 3222 along the axis direction of the accommodating portion 322 are respectively less than the thicknesses of side walls of the accommodating portion 322 where correspondingly defining the guiding recesses 3222, i.e., the side walls are not penetrated by the two guiding recesses 3222. Both the two locating recesses 3221 run through side walls of the accommodating portion 322, so that the accommodating portion 322 is more convenient to produce. In a used process, each of the protruding portions 3123 can be squeezed into the corresponding guiding recess 3222 by certain elasticity of the protruding portion 3123, and then enter the corresponding locating recess 3221, so that the first buckled portion 312 is buckled with the accommodating portion 322 more firmly.

It can be understood that the number of the protruding portions 3123 and the number of the locating recesses 3221 are not limited at two, and can be increased or decreased.

The second connecting portion 321 is cylindrical, and made of conductive metal. The second connecting portion 321 includes a second inserted pipe 3211 and a second sleeve 3212 integrated with the second inserted pipe 3211; and the second inserted pipe 3211 is configured to be connected to the battery pole 10; and the second sleeve 3212 is configured to be embedded by the accommodating portion 322. The second inserted pipe 3211 is coaxial with the battery pole 10; and an external diameter of the second inserted pipe 3211 is fit for an internal diameter of the battery pole 10, so that the second inserted pipe 3211 is inserted in the battery pole 10. An internal diameter of the second sleeve 3212 is fit for an external diameter of the accommodating portion 322, so that the accommodating portion 322 is interference fit in the second sleeve 3212. A second limiting ring 3213 is arranged on an end of the second connecting portion 321 that is adjacent to the accommodating portion 322; the second limiting ring 3213 is configured for preventing the second connecting portion 321 from being entirely inserted in the battery pole 10, so that the second connecting portion 321 can be disassembled from the battery pole 10 more easily.

The first electrode pillar 14 is embedded in the second connecting member 32. The second electrode pillar 23 is embedded in the first connecting member 31. The first connecting portion 311 is electrically connected to one end of the heating filament 221 of the atomizer 20, and the second electrode pillar 23 is electrically connected to the other end of the heating filament 221. The second connecting portion 321 is electrically connected to one terminal of the battery 12, and the first electrode pillar 14 is electrically connected to the other terminal of the battery 12. When the first connecting member 31 is buckled with the second connecting member 32, the first connecting portion 311 contacts the second connecting portion 321, and the first connecting portion 311 is electrically connected to the second connecting portion 321; and the first electrode pillar 14 abuts against the second electrode pillar 23, and the first electrode pillar 14 is electrically connected to the second electrode pillar 23. By this method, it is convenient to enable the battery 12 to supply electric power to the atomizer 20, and easy to disassemble the battery pole 10 from the atomizer 20, which is adapted for non-disposable electronic cigarettes.

It is can be understood that the first connecting portion 311 and the second connecting portion 321 can be made of non-metal isolated material; and thus the terminal of the battery 12 that is connected to the second connecting portion 321 in the aforementioned embodiment should be directly connected to the end of the heating filament 221 that is connected to the first connecting portion 311 in the aforementioned embodiment, by a conductive wire.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. All these modifications belong to the protection of the present application.

What is claimed is:

1. An electronic cigarette comprising a battery pole, an atomizer, and a connecting mechanism disposed between the battery pole and the atomizer and configured for connecting the battery pole to the atomizer; the connecting mechanism including a first connecting member and a second connecting member, wherein the first connecting member includes a first buckled portion and a first connecting portion detachably connected with the first buckled portion; the second connecting member includes a second connecting portion and an accommodating portion detachably connected with the second connecting portion; the accommodating portion fits for the first buckled portion; the first buckled portion is fixed in the accommodating portion, so that the first buckled portion is detachably buckled with the second connecting member;

wherein a side edge of the accommodating portion defines a guiding recess configured for cooperatively enabling the first buckled portion to be inserted in the accommodating portion; and an inner surface of the accommodating portion defines a locating recess disposed peripherally and communicating with the guiding recess;

wherein the first buckled portion includes a first section and a second section integrated with the first section; a protruding portion is arranged on edge of outside surface of the second section; when the first buckled portion is inserted in the accommodating portion, the protruding portion moves along the guiding recess and then enters rotationally the locating recess of the accommodating portion;

wherein the first buckled portion and the protruding portion are integrally made of plastic material by plastic injection; an axial direction of the protruding portion coincides with a radial direction of the second section;

wherein the accommodating portion is made of plastic material by plastic injection;

wherein the locating recess runs through a side wall of the accommodating portion;

and the protruding portion can be squeezed into the guiding recess by certain elasticity of the protruding portion, and then enters the locating recess;

wherein the first connecting portion is cylindrical; and the first buckled portion is cylindrical; and the first section is inserted in the first connecting portion;

wherein the electronic cigarette further comprises a first electrode pillar and a second electrode pillar, the first electrode pillar is passed through and located inside the accommodating portion of the second connecting member; the second electrode pillar is passed through and located inside the first buckled portion of the first connecting member; and wherein the first connecting portion and the second connecting portion are made of metal; when the first connecting member is buckled with the second connecting member, the first connecting portion is electrically connected to the second connecting portion, the first electrode pillar is abutted against with and electrically connected to the second electrode pillar, and the first electrode pillar is electrically insulated with the second connecting portion via the accommodating portion, the second electrode pillar is electrically insulated with the first connecting portion via the first buckled portion.

2. The electronic cigarette according to claim 1, wherein a first through-hole configured for air flow is defined in the first electrode pillar; and a second through-hole configured for air flow is defined in the second electrode pillar; and the first through-hole communicates with the second through-hole.

3. The electronic cigarette according to claim 2, wherein the atomizer includes a heating filament; and two ends of the heating filament are electrically connected to the first connecting portion and the second electrode pillar respectively; and two terminals of a battery are electrically connected to the second connecting portion and the first electrode pillar respectively.

4. The electronic cigarette according to claim 1, wherein a first limiting ring is peripherally mounted on an end of the first connecting portion that is adjacent to the first buckled portion.

5. The electronic cigarette according to claim 1, wherein a second limiting ring is peripherally mounted on an end of the second connecting portion that is adjacent to the accommodating portion.

6. The electronic cigarette according to claim 1, wherein a depth of the guiding recess along an axis direction of the accommodating portion is respectively less than a thicknesses of a side wall of the accommodating portion where correspondingly defining the guiding recess.

7. The electronic cigarette according to claim 1, wherein a chamfer configured for enabling the first connecting portion to be inserted in the atomizer more easily is arranged on an end of the first connecting portion that is away from the first buckled portion.

* * * * *